United States Patent [19]

Caputo et al.

[11] 4,019,606

[45] Apr. 26, 1977

[54] ELEVATOR SYSTEM

[75] Inventors: William R. Caputo, Wyckoff; Albert J. Pisatowski, Wayne, both of N.J.

[73] Assignee: Westinghouse Electric Corporation, Pittsburgh, Pa.

[22] Filed: Mar. 21, 1975

[21] Appl. No.: 560,460

[52] U.S. Cl. ..... 187/29 R; 318/480

[51] Int. Cl.[2] ..... B66B 1/40

[58] Field of Search ..... 187/29; 318/480

[56] References Cited

UNITED STATES PATENTS

| | | | |
|---|---|---|---|
| 3,001,131 | 9/1961 | Oliver | 318/480 X |
| 3,138,357 | 6/1964 | Whitwell et al. | 318/480 X |
| 3,486,640 | 12/1969 | Lemelson | 187/29 X |
| 3,743,056 | 7/1973 | Zitelli et al. | 187/29 |

*Primary Examiner*—Gene Z. Rubinson
*Assistant Examiner*—W. E. Duncanson, Jr.
*Attorney, Agent, or Firm*—D.R. Lackey

[57] ABSTRACT

An elevator system including an elevator car mounted in a structure to serve the landings therein, and an opto-electronic position detector for determining when the elevator car is within a predetermined distance from a selected landing. The position detector includes a source of electromagnetic radiation which is pulsed at a predetermined rate, such as a light emitting diode, and a photovoltaic device which provides an output current having a magnitude responsive to the level of the electromagnetic radiation it is subjected to, such as a photo transistor. The source of electromagnetic radiation and photovoltaic device are mounted in a common housing with a beam splitter, such as a half-silvered mirror, and this assembly is preferably mounted on the elevator car. A control device or target is mounted adjacent each landing to be served by the elevator car, with the control device including a retrodirective reflective surface or retroreflector. The housing is oriented such that the angle of incidence of a beam of electromagnetic radiation provided by the source of electromagnetic radiation strikes the retrodirective surface with an angle other than 90°. The photovoltaic device is electrically biased to provide an output current regardless of the level of the electromagnetic radiation applied to the photovoltaic device. When the photovoltaic device receives electrical radiation, such as from the retrodirective surface, its output current changes, and means responsive to changes in the output current energizes a translating device when the output current changes at a rate indicating the photovoltaic device is receiving the pulsed electromagnetic radiation from the source thereof.

7 Claims, 10 Drawing Figures

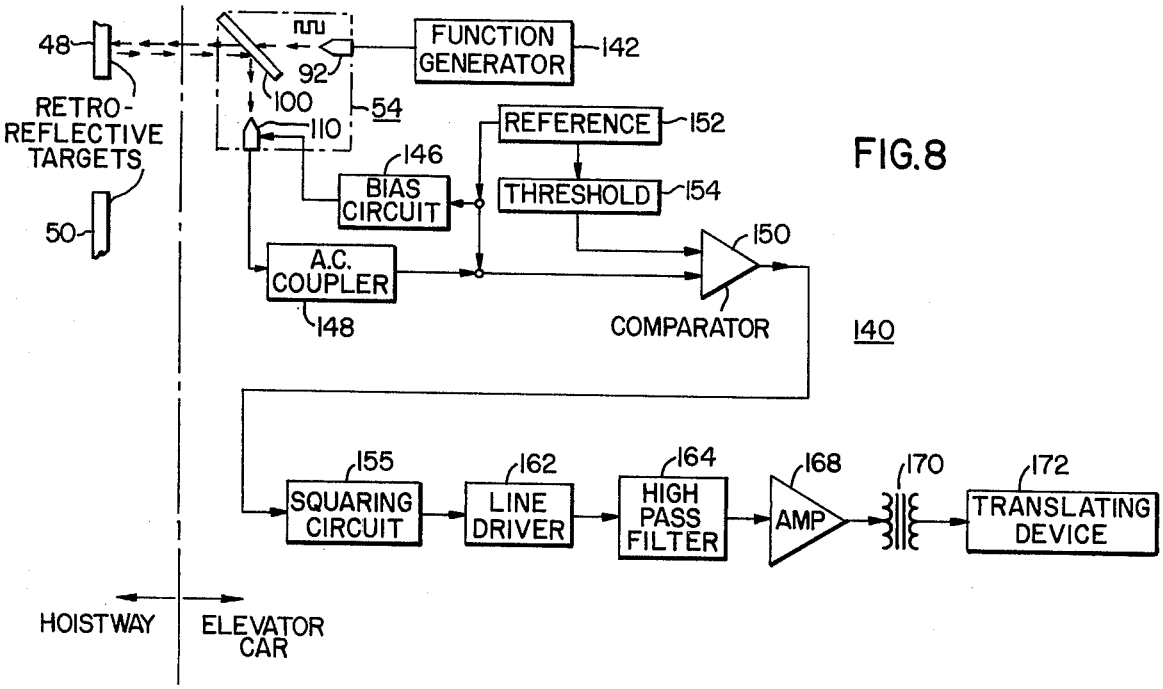
FIG.8
FIG.10
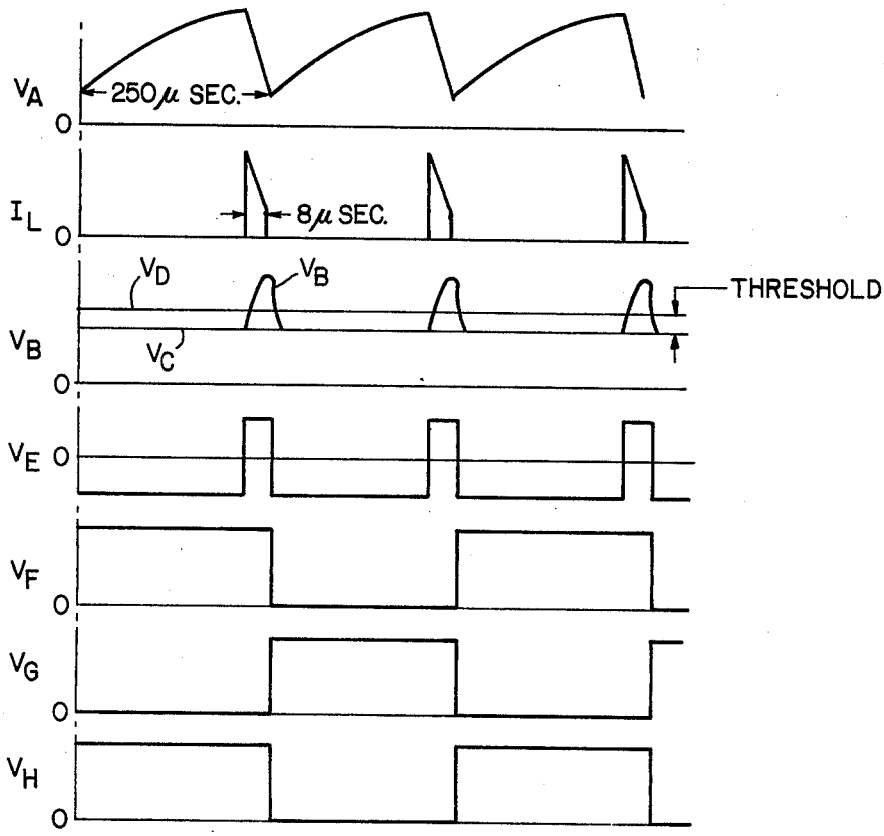

ELEVATOR SYSTEM

BACKGROUND OF THE INVENTION

1. Field of the Invention

The invention relates in general to elevator systems, and more specifically to elevator systems which include means for determining when an elevator car is within a predetermined distance from a selected landing.

2. Description of the Prior Art

Certain functions in the control of an elevator car are initiated when the elevator car is within a predetermined distance from a selected landing, i.e., the landing at which the elevator car is preparing to stop. For example, the deceleration of an elevator car may be controlled in two modes, with the first mode being under the control of a distance dependent speed pattern generator which provides a signal for the drive motor control proportional to the square root of the distance to go to the floor, and with the second mode deriving the speed pattern signal directly from transducers disposed adjacent each floor. Control is transferred from the first to the second mode at a predetermined distance from the floor, such as 10 inches (25.4 cm.). U.S. Pat. Nos. 2,874,806; 3,207,265 and 3,747,710, which are assigned to the same assignee as the present application, describe such slowdown arrangements. Thus, it is necessary to know, very accurately, when the elevator car reaches the 10 inch (25.4 cm.) point when approaching the floor from either travel direction. This same 10 inch (25.4 cm.) signal may be used to initiate pre-opening of the doors of the elevator car and hoistway. Since two 10 inch (25.4 cm. indicators are used, one for each direction, they may be vertically spaced about one-half inch (1.27 cm.) apart to provide a zone ± one-quarter inch (0.635 cm.) from floor level where neither indicator provides a signal, which indicates when the car is within one-quarter inch (0.635 cm.) of floor level. If the car moves outside this zone when standing at the floor with its doors open, one or the other of the 10 inch (25.4 cm.) indicators will initiate re-leveling.

In addition to the 10 inch (25.4 cm.) indicators, a second, completely independent indicator may be used which indicates when the car is within a predetermined zone adjacent the floor level, such as ± 2 inches (5.08 cm.) from floor level. This indicator represents a 4 inch (10.16 cm.) zone where the car is allowed to move below a very low speed with the doors open. If the car moves outside this zone with its doors open, or within the zone with the doors open but above a predetermined speed, certain protective actions are taken. Thus, it is desirable to know when the elevator car is within this ± 2 inch (5.08 cm.) zone relative to floor level.

Various control devices have been used for providing such control signals, such as mechanical switch/cam combinations, inductor relay/magnetic plate combinations, and photoelectric devices utilizing either photoconductive cells, such as photoresistors, or photovoltaic devices, such as phototransistors.

The cam operated mechanical switch is simple, but it is noisy and subject to mechanical wear and misalignment. The inductor relay devices are not subject to wear, but they are only useful for indicating approximate locations of the elevator car in the hoistway, such as for initiating slowdown points while the car is traveling at relatively high speeds several feet from the landing. In general inductor relays are not accurate enough to precisely indicate when the elevator car is within 10 inches of the landing, when the elevator car is within a ± one-quarter inch (0.635 cm.) zone from a landing, or when the elevator car is within a ± 2 inch (5.08 cm.) zone from the landing.

While the photoresistive devices provide the desired accuracy, they are not capable of operating at relatively high pulse rates, essential in light operated position indicators in order to reduce the incidence of false triggering caused by random light sources.

Photo devices, such as phototransistors, used in combination with light emitting diodes (LED) may be used to provide an excellent opto-electronic position detector for elevator systems, as they are capable of being pulsed in the kilohertz range, they are capable of providing the desired accuracy, and they have a long operating life. U.S. Pat. No. 3,743,056, which is assigned to the same assignee as the present application, discloses a new and improved opto-electronic position detector suitable for elevator systems, which is fail-safe, i.e., the failure of a circuit component will not cause false operation of the translating device or relay which is energized when two objects have a predetermined position relative to one another.

The position detector disclosed in U.S. Pat. No. 3,743,056 operates in the desired manner once the source of electromagnetic radiation, which will hereinafter be referred to as the LED, the target or reflector, and the photovoltaic device are properly aligned and mounted. It was found, however, that proper alignment and horizontal spacing of the components was critical and required considerable time and skill to properly mount these devices in the field. It was also found that the detector could be falsely actuated without the mirrored reflector due to a sensitivity of the circuitry to ambient light, coupled with "cross-talk" between the LED and phototransistor, and unwanted electrical coupling between other circuit components.

SUMMARY OF THE INVENTION

Briefly, the present invention is a new and improved elevator system which utilizes a position detector which preserves the fail-safe concept of the position detector disclosed in U.S. Pat. No. 3,743,056, while eliminating alignment and spacing problems of the components, and eliminating or substantially reducing the incidence of false operation of the detector due to ambient light sensitivity and cross-talk.

The alignment and spacing problem was solved by utilizing a target having a retroreflective surface, commonly called a triple mirror, which has a retrodirective characteristic, i.e., it returns a beam of electromagnetic radiation to its source, notwithstanding that the angle of incidence is other than 90°, a half-silvered mirror or beam splitter to direct the reflected beam to the phototransistor, and a common housing for the LED, beam splitter, and phototransistor dimensioned to automatically and accurately align the components. The housing is small enough to mount on the printed circuit board of the associated electronic circuitry, reducing lead capacitance problems and resulting undesired coupling. The housing provides a dust-proof enclosure for the components, and the opening for directing and receiving the beam of electromagnetic radiation is recessed to prevent dust in the hoistway from settling on the transparent cover which seals the opening.

The LED pulses of electromagnetic radiation are of very short duration, in order to reduce dissipation and increase the operating life of the LED and phototransistor. This, coupled with the inherently low efficiency of the beam splitter presented a problem in obtaining sufficient output current of the phototransistor in response to each LED pulse. This problem was solved, according to the teachings of the invention, by electrically biasing the phototransistor to continuously provide an output current, regardless of the level of ambient light. Thus, when the phototransistor receives the very short pulses from the LED at a kilohertz rate, the phototransistor output current immediately increases in response to the increased illumination without a delay due to turn-on time. The phototransistor thus provides a greater change in output current for a very short pulse of given intensity (lumens/ft.$^2$), than when the phototransistor is cut-off and subjected to the same short pulse. The output of the phototransistor is A.C. coupled to its amplifier, such as via a capacitor. Therefore, only the changes in the output current of the phototransistor are amplified. The level of the steady state output current of the phototransistor is not important.

When the electrically biased phototransistor is illuminated by a pulse of electromagnetic radiation from the LED its output current increases, which reduces its electrical bias. The output current thus does not reach the magnitude which it would if this reduction in base drive did not occur. This reduction in base drive during a pulse from the LED is prevented, according to the teachings of the invention, without affecting the ability of the base drive to change due to slower changes in ambient illumination, by capacitively coupling the base and emitter electrodes of the phototransistor, using a value for this capacitor which is large relative to the value of the capacitor which A.C. couples the output of the phototransistor to its amplifier. This capacitor holds the base drive substantially constant during the very narrow pulses of the electromagnetic radiation of the LED, i.e., the charging time of the capacitor is long compared with the width of the LED pulse, but allows the bias to change due to relatively slow changes in the ambient illumination.

An additional threshold circuit was provided which provides a threshold voltage which must be overcome by a change in the output of the phototransistor before the amplifier of the phototransistor output is effective. This additional threshold reduces the sensitivity of the detector to "noise", as ambient light will not reduce the threshold value. The threshold voltage must be overcome by a pulse. Reflections from smooth surfaces in the hoistway were eliminated by deliberately aiming the LED such that its pulsed beam of electromagnetic radiation strikes the retroreflective target with an angle of incidence which is close to the vertical but other than 90°. According to the teachings of the invention, the LED is aimed such that its beam of electromagnetic radiation strikes the retroreflector about 5° from a line perpendicular to the surface of the retroreflector, preventing smooth surfaces, other than the retroreflector from reflecting electromagnetic radiation from the LED to the phototransistor.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 8 is a block diagram which functionally illustrates a position detector system constructed according to the teachings of the invention;

FIG. 10 is a graph which illustrates voltage and current waveforms useful in understanding the operation of the detector system shown in FIG. 9.

DESCRIPTION OF THE PREFERRED EMBODIMENTS

Figure 1:
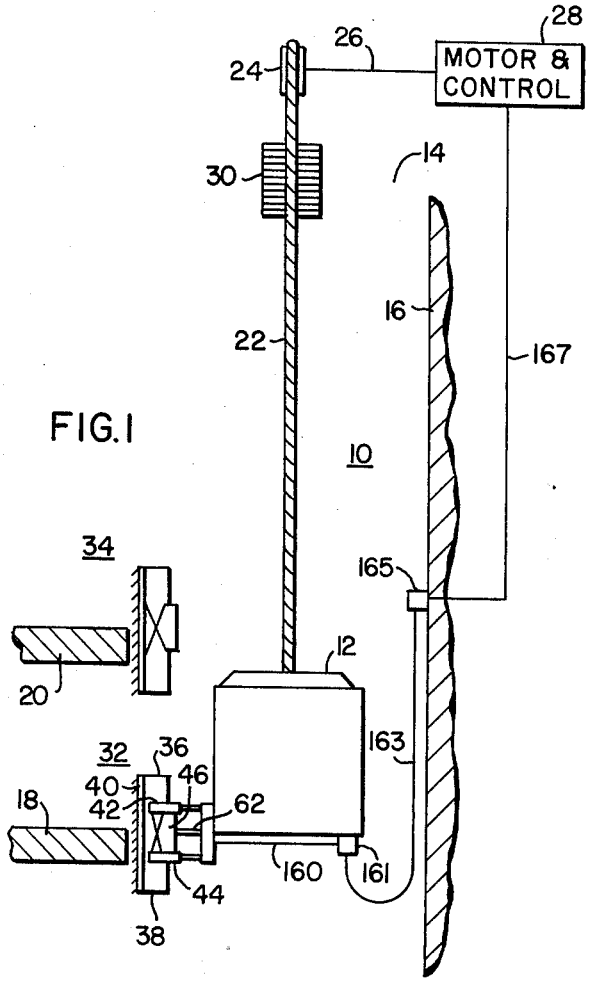
FIG. 1 is an elevational view of an elevator system which may be constructed according to the teachings of the invention, including detector apparatus for detecting the position of an elevator car relative to a landing.

Referring now to the drawings, and FIG. 1 in particular, there is shown an elevator system 10 constructed according to the teachings of the invention. Elevator system 10 includes an elevator car 12 mounted in a hoistway 14 for movement relative to a structure 16 having a plurality of floors or landings, such as floors 18 and 20. Elevator car 12 is supported by a plurality of wire ropes, shown generally at 22, which are reeved over a traction sheave 24 mounted on the shaft 26 of a drive motor shown generally at 28. A counterweight 30 is connected to the other ends of the ropes 22.

Elevator system 10 includes an opto-electronic position detector arrangement for developing certain position signals when the elevator car approaches and stops at a floor. The position detector arrangement includes control devices, hereinafter referred to as targets, mounted adjacent each floor level to be served by the elevator car 12, transmitter means for transmitting pulsed electromagnetic radiation, and receiver means for receiving the pulsed electromagnetic radiation when it is reflected from the target, and including circuitry for processing the reflected electromagnetic radiation to operate a translating device from a first to a second condition only when such electromagnetic radiation is that which was developed by the transmitter means and reflected from the target. The circuitry for performing this processing function must be fail-safe, such that failure of any component will not falsely operate the translating device.

For purposes of example, it will be assumed that the elevator system 10 utilizes the magnetic plate-inductor arrangement of the hereinbefore mentioned U.S. Pat. Nos. 2,874,806 and 3,207,265, and thus the targets for the position detector system may be mounted on the magnetic plates which are positioned at each floor in such a system. However, it will be understood that the targets may be separately mounted adjacent each landing, if desired.

Figure 2:
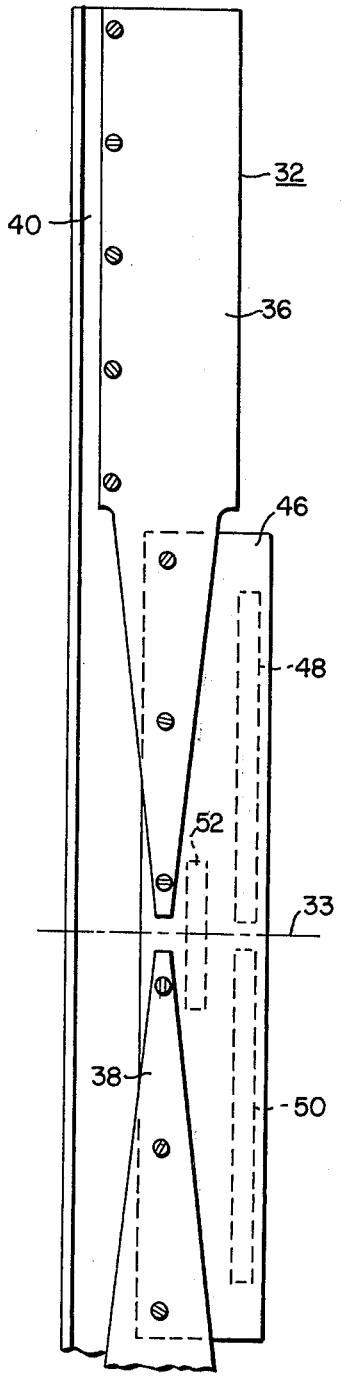
FIGS. 2 and 3 are elevational and plan views, respectively, which illustrate in greater detail the target arrangement for the detector apparatus shown in FIG. 1.

More specifically, floors 18 and 20 include stationary assemblies 32 and 34 which are of similar construction. Thus, only assembly 32 is described in detail. Assembly 32 is illustrated in greater detail in FIGS. 2 and 3. Referring to FIG. 2, which is an elevational view, assembly 32 is symmetrical about the horizontal center line 33 which is aligned with the level of the associated floor, and it includes upper and lower tapered magnetic plate members 36 and 38, respectively, which are suitably fastened to one arm of a right angle member 40. The remaining arm of the right angle member is fixed to the hoistway wall in any suitable manner, with the second arm, on which the magnetic plates are mounted, extending outwardly into the hoistway. The magnetic plates 36 and 38 are fixed to the second or outwardly extending arm of the right angle member 40 in vertically spaced relation such that their major opposed sides or surfaces are vertically aligned with one another, and with their tapered portions adjacent one another to provide an hourglass configuration. First and second vertically spaced transformer arrangements 42 and 44, shown in FIG. 1 are carried by the elevator car 12, with the magnetic plate members separating and shielding the first and second windings of each transformer arrangement as the elevator car approaches the floor level. Transformers 42 and 44 cooperatively provide a signal which is reduced continuously to zero as the elevator car approaches the floor from a displacement of about 10 inches therefrom to floor level, with this signal being used as the speed pattern signal for the elevator drive motor control.

Figure 3:
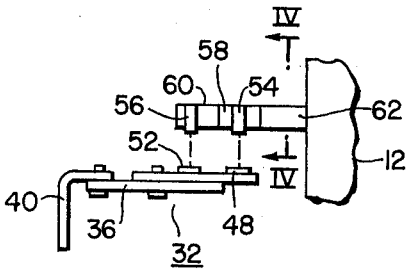

In the embodiment of the invention shown in FIGS. 2 and 3, two lanes of targets are used for each floor to develop two separate car position signals, but any number of lanes may be used, depending upon the different car position signals desired. The lanes of targets are mounted on a non-magnetic plate member 46, which is fastened to the magnetic plate members 36 and 38 with the flat major opposed sides or surfaces of the plate in vertical planes. Plate 46 has a first target lane mounted thereon which includes vertically spaced targets 48 and 50, and a second target lane mounted thereon which includes target 52. Targets 48 and 50, each of which are dimensioned 9¾ inches (24.77 cm.) × 1 inch (2.54 cm.), start 10 inches (25.4 cm.) above and below the floor level 33 and they stop one-quarter inch (6.35 cm.) from the floor level to provide a vertical space having a dimension of one-half inch (1.27 cm.) between their adjacent ends. Target 52 has a vertical dimension of 4 inches (10.16 cm.) and is fastened to plate member 46 such that the floor level 33 bisects the target.

Targets 48, 50 and 52 are formed of a material which has a retrodirective characteristic, commonly called a retroreflector or triple mirror. The retrodirective characteristic refers to that characteristic which causes the retroreflector to return a beam of electromagnetic radiation to its source, notwithstanding that the angle of incidence is other than 90°. Material having a retrodirective characteristic is available in tape or strip form, with the tape having an adhesive backing which simplifies the application to the plate member 46. Minnesota Mining and Manufacturing Company's tape sold under the trade name SCOTCH Q-CORNER, or equivalent, may be used. The efficiency of a retroreflector in returning a beam of electromagnetic radiation to its source is a maximum for an angle of incidence of 90°, and it remains substantially constant as the angle of incidence is dropped from 90° to about 85°. The efficiency then drops as the angle of incidence is reduced below 85°. This characteristic is used to advantage in the present invention, as will be hereinafter explained.

Two separate detector assemblies 54 and 56, shown in FIG. 3, are used, one for each target lane. Each detector assembly includes a source of electromagnetic radiation, which will be hereinafter assumed to be an LED, a beam splitter or half-silvered mirror, and a photoresponsive device which will be assumed to be a phototransistor, all mounted in a sealed unitary housing. These components may be packaged in a housing which is small and light enough to be mounted on a printed circuit board which includes some of the associated electronic circuitry for generating, receiving and processing the detected electromagnetic radiation. As illustrated in FIG. 3, detector assemblies 54 and 56 are mounted on printed circuit boards 58 and 60, respectively, which in turn are mounted on a bracket member 62 fixed to the elevator car. The transformer arrangements 42 and 44 are not shown in FIG. 3, in order to more clearly illustrate the opto-electronic detector arrangment. Since detector assemblies 54 and 56 are of like construction, only assembly 54 will be described in detail.

Figure 4:
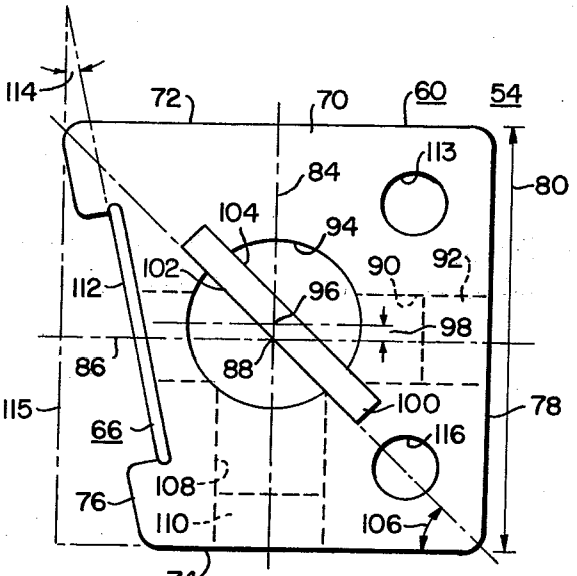
FIGS. 4 and 5 are elevational and plan views, respectively, of an LED, phototransistor, beam splitter assembly mounted in a common unitary housing, with FIG. 4 being a view of this assembly taken generally in the direction of arrows IV—IV shown in FIG. 3.
Figure 5:
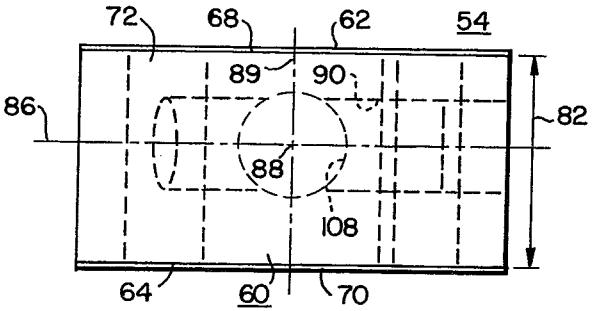

FIG. 4 is an elevational view of assembly 54, taken in the direction of arrows IV—IV in FIG. 3, and FIG. 5 is a plan view of the assembly shown in FIG. 4. A side cover of assembly 54 is removed in FIG. 4 in order to clearly illustrate the assembly of components. Assembly 54 includes a housing which is formed of a block member 60, first and second side plate members 62 and 64, and a lens 66, such as glass, through which electromagnetic radiation at the wavelength of the LED is free to pass.

Block member 60 includes first and second major side surfaces 68 and 70, top and bottom surfaces 72 and 74, respectively, and front and back surfaces 76 and 78, respectively. The front surface 76 is angled inwardly, starting at the top surface 72. Except for this angled front surface, the side surfaces would define a square configuration, with each side of the square being about 0.88 inch, with one side of this configuration being indicated by reference 80. The depth dimension of the block 60, indicated by reference 82, is about 0.39 inch.

Vertical and horizontal center lines through the block 60 are indicated at 84 and 86, respectively, which intersect at the geometrical center of the block 60, assuming a square configuration, with this center point being indicated at 88. A horizontal center line 89 through the block 60, perpendicular to the sides 68 and 70, shown in FIG. 5, also intersects the center lines 84 and 86 at point 88. A first opening 90 coaxial with center line 86 is disposed through block 60, between the front 76 and the back 78. This opening is sized to receive a light emitting diode (LED) indicated at 92, such as a diameter of 0.170 inch (0.432 cm.). LED 92 is mounted in opening 90 with a suitable adhesive, which seals the opening 90 at the back surface 78 of the block 60. LED 92 is oriented to direct a beam of electromagnetic radiation along center line 86 to the front 76 of the block 60.

A second opening 94 extends through the block 60 between its sides 68 and 70. The central axis 96 of opening 94 intersects the vertical center line 84 of the block, but it is spaced above the horizontal center line 86 by a dimension indicated at 98, such as 0.025 inch (0.635 mm.). The diameter of opening 94 is about 0.34 inch (0.864 cm.).

A slot in which a beam splitter or half-silvered mirror 100 is mounted, is disposed through block 60, with this slot extending between sides 68 and 70. Beam splitter 100 includes first and second major opposed rectangularly shaped surfaces 102 and 104 having a dimension of about 0.38 inch (0.97 cm.) by 0.50 inch (1.27 cm.), with the thickness dimension of the beam splitter being about 0.062 inch (1.57 mm.). The beam splitter 100 may be formed of glass suitable for infrared light having a wavelength of 9400A. Surface 102 of beam splitter 100 is coated with a thin layer of silver, aluminum, or other suitable metallic material of such thickness that about 50% of the light normally incident on the surface will be transmitted, and the remainder will be reflected. A beam splitter of such construction is commonly referred to as a half-silvered mirror, and is available from Evaporated Metal Film Corporation, Ithaca, N.Y.

The slot for beam splitter 100 is oriented such that the half-silvered surface 102 is in a plane which includes point 88, with this plane intersecting the planes which include the top 72, bottom 74 and back 78 of block 60 at a 45° angle, such as indicated by angle 106. The dimensions of the slot in which beam splitter 100 is disposed, as viewed in the FIG. 4 orientation, are about 0.52 inch (1.32 cm.) × .070 inch (0.178 cm.). The midpoint of the 0.52 inch (1.32 cm.) dimension is on the central axis 96 of the second opening 94.

A third opening 108 extends from the bottom 74 of block 60 to the second opening 94. The central axis of opening 108 is coaxial with the vertical center line 84 of block 60. Opening 108 is dimensioned to receive a phototransistor 110, with the diameter of the opening being about 0.170 inch (0.432 cm.). The phototransistor 110 is mounted in the third opening 108 with a suitable adhesive, sealing the bottom entrance to the opening. The lens of the phototransistor is aimed along vertical axis 84, towards point 88.

The cover or lens 66 on the housing may be formed of non-reflecting glass, and is a non-focusing lens since the LED 92 and phototransistor 110 each include a focusing lens as part of their package. As indicated in FIG. 4, lens 66 may be mounted in a slot which extends between the sides 68 and 70, dimensioned to receive the lens. The lens 66 may have the same dimensions as the beam splitter 100, i.e., 0.38× 0.50 × 0.062 inch (0.97 × 1.27 × 0.157 cm.). The outer surface 112 of lens 66 lies in a plane which forms an angle 114 with an imaginary plane 115. Imaginary plane 115 is a vertical plane which completes the square configuration of the side surfaces 68 and 70. Angle 114, which may be about 15°, protects the outer surface 112 of the lens 66 from vertically falling dust in the hoistway.

Openings 113 and 116 are disposed through block 60, extending between sides 68 and 70, for receiving fasteners which secure the block 60 to the associated printed circuit board. When the side plate members are secured to the block 60, such as by a suitable adhesive, a completely dust-tight enclosure is formed which protects the beam splitter 100, LED 92, and phototransitor 110 from dust.

Block 60 may be cast accurately to shape from a metal, such as aluminum, or it may be a machined metallic or plastic block. It is important that all interior surfaces of the block be non-reflective, i.e., a flat black color. The beam splitter 100 is accurately located by the slot, and the LED 92 and phototransistor 110 are accurately located by the openings 90 and 108, respectively. Thus, alignment and spacing of the components is automatic, and it does not require time consuming alignment or spacing in the field.

Figure 6:
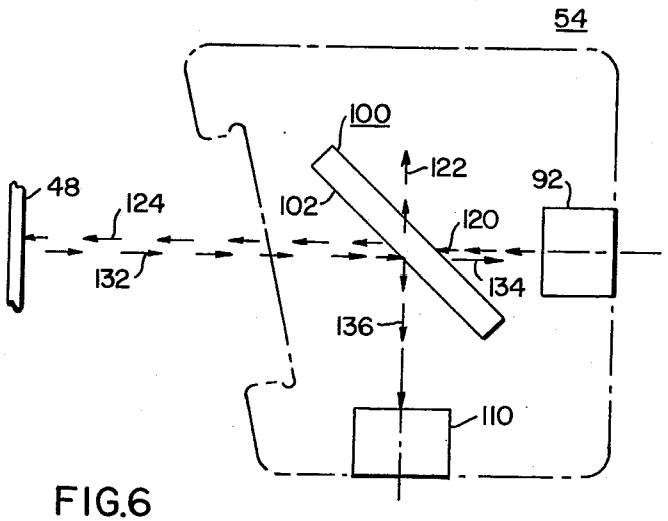
FIGS. 6 and 7 are elevational and plan views, respectively, which correspond generally to FIGS. 4 and 5, respectively, with FIGS. 6 and 7 diagramatically illustrating the operation of the assembly relative to generated and reflected beams of electromagnetic radiation.
Figure 7:
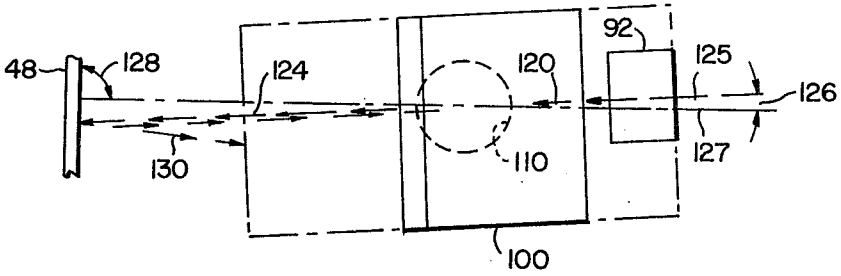

FIG. 6 and 7 are elevational and plan views, respectively, of detector assembly 54, functionally illustrating the operation of the detector. As illustrated in FIG. 6, LED 92 generates a pulsed beam 120 of electromagnetic radiation, which strikes surface 102 of the beam splitter with an angle of incidence of 45°. Approximately one-half of the beam energy is reflected, indicated by arrows 122, and the remaining beam energy is transmitted through the beam splitter, indicated by arrows 124, continuing the original orientation of the beam with a slight offset due to refraction. A horizontal plane through beam 124 is perpendicular to the orientation of the target surfaces, such as target 48.

FIG. 7 clearly illustrates a deliberate skewing of the detector assembly 54 such that the beams 120 and 124 are in a vertical plane which strike the target surface with an angle other than 90°. The central axis 125 of LED 92 forms an angle 126 with a line 127 which is perpendicular to the target face, as indicated by angle 128, which angle is 90°. Angle 126 is about 5 degrees. A retrodirective surface returns a beam of electromagnetic radiation to its source when the beam angle is 5° from the perpendicular, with substantially no drop in efficiency, compared with the efficiency of the surface in returning a normally incident beam to its source. Thus, when the beam 124 strikes a smooth surface, other than a rectrodirective target, the beam is reflected away from the smooth surface with an angle of reflection equal to the angle of incidence, i.e., 85°, with this reflection of the beam being indicated by arrows 130 in FIG. 7. Thus, the reflected beam is not returned to the opening of the detector, and will not cause unwanted coupling between the LED and photodiode.

Referring again to FIG. 6, when the beam 124 strikes the retrodirective surface of a target it is reflected back to the source, indicated by arrows 132. When the reflected beam 132 strikes surface 102 of the beam splitter 100, approximately one-half of the beam is transmitted, indicated by arrows 134, and the remaining portion, indicated by arrows 136, is reflected along the center line 84 into the lens of the phototransistor 110.

Figure 9:
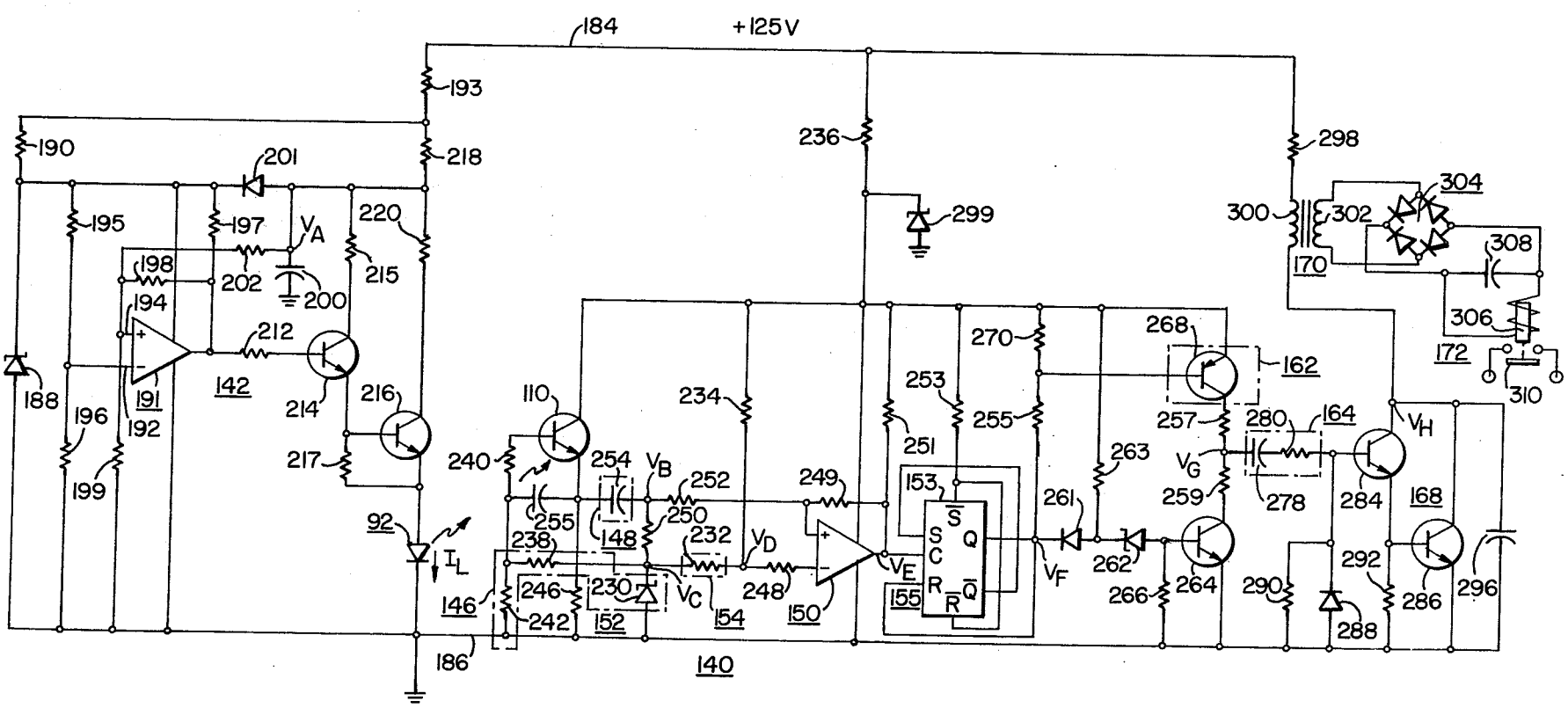
FIG. 9 is a schematic diagram which illustrates in detail a position detector system constructed according to the block diagram shown in FIG. 8.

While the arrangement of the LED 92 and phototransistor 110 in a common housing with beam splitter 100, along with targets formed of retrodirective material solves alignment, spacing, and cross-talk problems, as well as maintaining the components clean and dust-free, it will be noted that only about 15% of the beam energy generated by LED 92 is returned to the phototransistor 110. Circuit arrangements which partially overcome the relatively low efficiency of the beam splitter 100 are shown in FIGS. 8 and 9, and will now be described.

FIG. 8 is a block diagram of a detector circuit 140 which includes the LED 92 and phototransistor 110, which circuit processes the illumination to which the phototransistor is subjected, and when such illumination is from LED 92, a translating device is operated to provide a signal that the elevator car 12 bears a predetermined spatial relationship with a retrodirective target.

More specifically, a function generator 142 generates a repetitive electrical signal which drives the light-emitting diode 92. A light-emitting diode (LED) which emits light in the visible spectrum may be used. However, an infrared LED, such as General Electric's SSL-5c, is used in the preferred embodiment of the invention. It is to be understood, however, that any control device which emits electromagnatic radiation having a wavelength in the range of approximately 2,000 to 10,000A may be used. The light-emitting diode is used in the preferred embodiment as it has the advantage of long life, and it may be pulsed at frequencies in the megahertz range.

A function generator which generates any repetitive electrical signal may be used for the function generator 142. However, a relaxation oscillator which generates a signal having a frequency of 4 kilohertz is selected for the preferred embodiment. The LED 92 therefore emits pulses of infrared radiation having a frequency of 4 kilohertz. It is unlikely that there would be stray radiation modulated at the same frequency in the environment in which the device is to be utilized.

The phototransistor 110 is operative to generate electrical pulses having a frequency corresponding to that of the pulses of infrared energy triggering it. The phototransistor is capable of generating pulses in the kilohertz range, unlike the photoresistor which is commonly referred to as the photocell.

In order to partially overcome the relatively low efficiency of the beam splitter 100 a bias circuit 146 electrically biases the phototransistor 110 to its conductive state, and the output of the phototransistor 110 is passed through an A.C. coupler 148. Thus, the steady state output current of the phototransitor 110 is not important, as only changes in the output current of the phototransistor 110 are passed through the A.C. coupler 148. The pulses of electromagnetic radiation from LED 92 are necessarily of a very short duration, such as 8 microseconds, in order to reduce dissipation in the LED and phototransistor and assure long operating life. The turn-on time of the phototransistor, however, is an appreciable portion of the LED pulse, and if the LED pulse is used to turn on the phototransistor, the output current of the phototransistor is cut-off at a magnitude below that at which the phototransistor is capable of supplying for the intensity of the beam received. By biasing the phototransistor to its conductive state, its output current responds much faster to the illumination from the LED and its output current thus reaches a higher magnitude, partially offsetting the relatively low efficiency of the beam splitter 100.

The output of the A.C. coupler 148 is applied to one input of a comparator/amplifier 150. A reference 152 sets the output level of the A.C. coupler 148 to a predetermined value when the A.C. coupler is not providing a pulse. Reference 152 is applied to the other input of comparator/amplifier 150 through a threshold 154. When the output voltage of the A.C. coupler 148 increases due to a change in the output of phototransistor 110, and this change exceeds the threshold, comparator 150 provides an output signal which is applied to a squaring circuit 155. If the output signal of the squaring circuit exceeds a predetermined threshold it is amplified and applied to a line driver 162. The remaining portion of the detector circuit may be located remotely from the portion described to this point, if desired, proceeding through a transmission line 160 to a junction box 161 carried by the car, the latter elements being illustrated in FIG. 1. The signal then proceeds through the traveling cable 163 to a junction box 165 in the hoistway, and from there to the motor control 28 via cable 167.

A high pass filter 164, and an amplifier 168 provide a reliable signal to an isolation transformer 170. The isolation transformer is connected to a translating device 172.

FIG. 9 is a schematic diagram of detector circuitry which may be used to perform the function of the detector circuit 140 shown in block form in FIG. 8. Like reference numerals in FIGS. 8 and 9 indicate like functions. FIG. 10 is a graph which illustrates voltage and current waveforms at selected points of the detector circuit shown in FIG. 9, and will be referred to when describing FIG. 9.

More specifically, the detector circuitry 140 includes buses 184 and 186, with a supply voltage of 125 volts D.C. being applied between buses 184 and 186. Bus 186 is connected to ground potential. A Zener diode 188 cooperates with resistors 190 and 193 to provide a 30 volt supply for the function generator 142. Function generator 142 includes a comparator 191, such as Fairchild's LM 311, which has an inverting input 192 and a non-inverting input 194. The inverting input 192 is connected to a voltage divider which includes resistors 195 and 196 serially connected from the cathode of Zener diode 188 to bus 186. The noninverting input 194 is connected to a voltage divider which includes resistors 197, 198 and 199 serially connected from the cathode of Zener diode 188 to bus 186. A capacitor 200 has one plate connected to bus 184 via resistors 218 and 193, and its other plate is grounded. The ungrounded plate of capacitor 200 is also connected to the cathode of Zener diode 188 via a diode 201 poled to conduct current towards the Zener diode, and to the non-inverting input 194 of comparator 191 via a resistor 202. The output of comparator 191 is connected to the base of an NPN transistor 214. The collector of transistor 214 is connected to bus 184 via a resistor 215 and resistors 218 and 193. The emitter of transistor 214 is connected to the base of an NPN transistor 216 and to bus 186 via a resistor 217 and LED 92. The collector of transistor 216 is connected to bus 184 via a resistor 220, and resistors 218 and 193. The emitter of transistor 216 is connected to bus 186 via LED 92.

The function generator 142 described is a relaxation oscillator, with the capacitor 200 and resistors being selected to provide a frequency of 4000 Hz. The voltage dividers to which comparator 191 is connected are selected such that the inverting input 192 is more positive than the non-inverting input 194, causing the output of comparator 191 to be negative. Capacitor 200 charges through resistors 193 and 218 until the capacitor voltage applied to the non-inverting input 194 via resistor 194 drives the non-inverting input 194 more positive than input 192. When this occurs, the output of the comparator switches positive, turning transistor 214 on. Transistor 214 provides base drive current for transistor 216, which causes it to saturate. In the saturated state, the collector to emitter impedance of transistor 216 drops to essentially zero, and LED 92 is turned on causing it to emit radiation in the infrared range. Capacitor 200 discharges rapidly through the low impedance path which includes the saturated transistor 216, LED 92 and resistor 220. Resistor 220 has a relatively small value, such as 10 ohms. When capacitor 200 discharges, the output of comparator 191 switches negative, transistors 214 and 216 turn off and LED 92 terminates its emission of infrared light. Thus, LED 92 generates very short pulses of infrared radiation as a function of a positive signal appearing at the output of comparator 191. The voltage waveform at the ungrounded plate of capacitor 200, which is reference voltage $V_A$, is shown in FIG. 10. When voltage $V_A$ reaches a predetermined magnitude, current flows through LED 92, with the LED current being referenced $I_L$ in FIG. 10. Diode 201 prevents the capacitor voltage from exceeding that of the cathode of Zener diode 188. Each cycle of the relaxation oscillator has a duration of 250 microseconds, with LED 92 providing radiation for only 8 microseconds of each cycle.

The receiver portion of detector 140, which operates in response to the transmitter portion just described, includes the phototransistor 110, a bias circuit 146, an A.C. coupler 148, comparator/amplifier 150, reference voltage source 152, and threshold 154.

The reference voltage source 152 includes a Zener diode 230 which has its anode connected directly to bus 186, and its cathode connected to bus 184 via resistors 232, 234 and 236.

The bias circuit 146 includes Zener diode 230 and resistors 238 and 242. Resistors 238 and 242 are serially connected from the cathode of Zener diode 230 to bus 186. A resistor 240 is connected from the junction between resistors 238 and 242 to the base electrode of phototransistor 110. A resistor 246 is connected from the emitter electrode of phototransistor 110 to bus 186, and the collector electrode of phototransistor 110 is connected to bus 184 via resistor 236. A Zener diode 299 has its cathode connected to the collector of phototransistor 110 and its anode is connected to ground. The base of phototransistor 110 is thus positive with respect to its emitter, and this base drive biases the phototransistor 110 to its conductive state.

Zener diode 230 also provides a reference voltage, which function is indicated by block 152 in FIG. 8, for the comparator/amplifier 150, which may be an operational amplifier having non-inverting and inerting inputs, indicated by the positive and negative polarity signs, respectively, such as Fairchild's LM 311. The cathode of Zener diode 230 is connected to the inverting input of operational amplifier 150 via resistor 232 and a resistor 248, and the cathode of Zener diode 230 is connected to the non-inverting input of operational amplifier 150 via resistors 250 and 252. The non-inverting input is connected to bus 184 via resistors 249, 251 and 236. The values of the resistors associated with the inverting and non-inverting inputs are selected such that the non-inverting input of operational amplifier 150 is slightly negative with respect to the inverting input, resulting in the operational amplifier 150 providing a negative output voltage. Threshold 154 is provided by resistor 232 which provides a voltage difference between the inputs of operational amplifier 150 which prevents the operational amplifer 150 from being triggered by small changes in the output current of phototransistor 110. Resistor 232 is selected to provide a voltage drop of about 0.6 volt by current flowing through resistors 232 and 234 and Zener diode 230, which must be overcome by a change in the output of phototransistor 110 which is rapid enough to pass through the A.C. coupler 148, before operational amplifier 150 will provide a positive output. Thus, this threshold is not affected by slow changes in the output of the phototransistor, and the full value of the threshold is always applied to a pulse.

The A.C. coupler 148, which couples changes in the output of phototransistor 110 to the non-inverting input of operational amplifier 150 may be a capacitor 254, which is connected from the emitter electrode of phototransistor 110 to the junction between resistors 250 and 252. The steady state value of the voltage drop across resistor 246 will be blocked by capacitor 254. Capacitor 254, however, will transmit changes in the output current of phototransistor 110, such as when the output current of phototransistor 110 increases due to the infrared radition from LED 92. These rapid changes in the output current of phototransistor 110 due to the pulsed infrared radiation from LED 92 cause the operational amplifier 150 to switch between a positive and negative output at the same rate as the pulses are provided by LED 92.

When phototransistor 110 is subjected to pulsed infrared radiation from LED 92 its output increases and decreases at the pulse rate of LED 92. The increasing output current during each pulse of infrared radiation would normally reduce the base drive of the phototransistor 110, and thus its output current would not change to the extent that it would with a fixed bias. According to the teachings of the invention, however, the emitter to base bias is fixed for the duration of a pulse of the LED 92, without fixing the bias for changes in illumination which occur over a period of time longer than the pulse width, by connecting a capacitor 255 from the emitter of phototransistor 110 to the junction between the resistors 238 and 240. Capacitor 255 is selected to have a much longer time constant than capacitor 254, such as about 10 times longer. Thus, capacitor 255 will hold the bias for the duration of an LED pulse, while permitting the bias to change during changes in ambient light.

FIG. 10 illustrates the operation of the A.C. coupler 148 and threshold 154. The voltage at the junction of capacitor 254 and resistor 250 is referenced $V_B$, with this voltage being the result of a change in the output current of phototransistor 110 through resistor 250 plus voltage $V_C$. Voltage $V_C$ appears at the cathode of Zener diode 230. Voltage $V_B$ must exceed the voltage $V_D$ at the junction of resistors 232 and 234 before it will affect comparator 150. Thus, the pulse voltage developed across resistor 250 must exceed the threshold voltage $V_D - V_C$ which appears across resistor 232.

The output voltage $V_E$ of comparator 150 is negative until voltage $V_B$ exceeds voltage $V_D$, at which point the output voltage $V_E$ of comparator 150 is driven positive. As illustrated in FIG. 10, the output voltage of comparator 150 is positive for only about the duration of the LED pulse, i.e., about 8 microseconds.

The output of comparator 150 is applied to a squaring circuit 155, which may be a master-slave R-S flip-flop 153, such as Motorola's MC 664, connected as a divide-by-two counter. The output of comparator 150 is connected to the clock input C of flip-flop 153, and to the junction of resistors 249 and 251. The reset input R of flip-flop 153 is connected to its Q output, its set input S is connected to its $\overline{Q}$ output, inputs $\overline{S}$ and $\overline{R}$ are connected to bus 184 via resistors 253 and 236, and the Q output is connected to bus 184 via resistors 255, 270 and 236.

As illustrated in FIG. 10, the Q output voltage $V_F$ of flip-flop 153 changes logic level each time the clock input voltage $V_E$ goes negative, providing the square wave illustrated at $V_F$.

Line driver 162, which may be a PNP transistor 268, is connected to be responsive to the Q output of flip-flop 153, with its base being connected to the junction of resistors 255 and 270, its collector connected to bus 184 via resistor 236, and its emitter connected to bus 186 via resistors 257 and 259 and the collector-emitter path of an NPN transistor 264. The base of transistor 264 is connected to the Q output of flip-flop 153 via Zener diode 262 and a diode 261. The base of transistor 264 is connected to the anode of Zener diode 262, the cathode of Zener diode 262 is connected to the anode of diode 261 and to the bus 184 via resistors 263 and 236, and the cathode of diode 261 is connected to the Q output of flip-flop 153.

When the Q output of flip-flop 153 is high, the base of transistor 268 is at about the same potential as its emitter, and transistor 268 is cut-off. Diode 261 is back biased, Zener diode 262 is conductive and transistor 264 is conductive. With transistor 268 cut-off and transistor 264 conductive, the voltage $V_G$ at the junction of resistors 257 and 259 is the same as bus 186, i.e., ground.

When the Q output of flip-flop 153 is low, the base of transistor 268 is more negative than its emitter and transistor 162 is conductive. Diode 261 is forward biased and Zener diode 262 blocks current flow from its cathode to its anode. Thus, the voltage $V_G$ is about that of the junction of resistor 236 and the cathode of Zener diode 299.

The voltage $V_G$ at the junction between resistors 257 and 259 is applied to an amplifier 168 via a high pass filter 164. High pass filter 164 includes a capacitor 278 and a resistor 280. Amplifier 168 includes a pair of NPN transistors 284 and 286. The base of transistor 284 is connected to the high pass filter 164, to the cathode of a diode 288, which has its anode connected to bus 186 and to bus 186 via resistor 290. The collector electrode of transistor 284 is connected to bus 184 via the primary winding 300 of isolation transformer 170 and a resistor 298, to the collector of transistor 286, and to bus 186 via a capacitor 296. The emitter of transistor 284 is connected to the base of transistor 286 and to bus 186 via a resistor 292. The emitter of transistor 286 is connected to bus 186. In addition to primary winding 300, isolation transformer 170 includes a secondary winding 302 which is connected to the translating device 172. When transistor 268 of line driver 162 is conductive, and voltage $V_G$ is thus high, current is supplied through resistor 257 which tends to charge capacitor 278 of the high pass filter 164. Transistor 284 is thus provided with base drive current which turns it on.

When transistor 284 turns on, transistor 286 is provided with base drive current, turning it on, and current passes through the primary winding 300 of the isolation transformer 170. When transistor 286 turns on, the voltage at its collector, $V_H$ in FIG. 10, drops to ground potential.

When the output voltage $V_F$ of flip-flop 153 goes high, transistor 264 is turned on, and the base of transistor 268 is at approximately the same potential as its emitter which turns transistor 268 off. Capacitor 278 will then tend to discharge through transistor 264. This causes the base of transistor 284 to go negative with respect to the emitter which turns transistors 284 and 286 off, and current flow through the primary winding 300 is terminated.

When transistors 284 and 286 are conductive, to energize the primary winding 300 of the isolation transformer 170, a build-up of the magnetic field in the primary winding 300 induces current in the secondary winding 302, which is connected to the translating device 172. Translating device 172 may include a full-wave bridge rectifier circuit 304 and a relay 306 having a contact 310. A capacitor 308 is connected across the output of rectifier 304. When current is induced into the secondary winding 302, it is rectified by the rectifier 304 which supplies direct current to the coil of the relay 306. Capacitor 308 serves as a filter for the bridge curcuit. When transistors 284 and 286 are again turned off, the collapse of the field in the primary winding 300 again induces a pulse into the secondary winding 302. Continued pulsing of the transformer 170 generates sufficient direct current to maintain relay 306 in the energized state. Capacitor 296 is provided to protect transistors 284 and 286 from spikes caused by the discontinuities of the current in the primary of the isolation transformer 170.

Relay 306 will be energized only when phototransistor 110 is subjected to pulses of infrared radiation emitted by LED 92. The strength of the incidient infrared radiaion must be sufficient to overcome threshold 154. The value of the electrical signals generated by the phototransistor 110 must exceed the reference voltage by an amount which is a function of the voltage drop across resistor 232. The A.C. coupling provided by transformer 170 precludes false energization of relay 306 due to failure of a component, such as the failure of transistor 286 in the conductive condition.

Transformer 170 is an isolation transformer constructed such that only signals in the kilohertz range applied to primary winding 300 will induce current into the secondary winding 302. This further improves the reliability of the system by precluding false triggering by stray signals in other frequency ranges.

We claim as our invention:

1. An elevator system, comprising:

a structure having a plurality of landings, an elevator car mounted for movement relative to said structure to serve at least certain of the landings, transmitter means providing electromagnetic radiation having a predetermined wavelength, with the electromagnetic radiation being pulsed at a predetermined rate, receiver means responsive to electromagnetic radiation of the wavelength provided by said transmitter means, a housing, beam splitter means, said transmitter means, receiver means, and beam splitter means being mounted within said housing with predetermined orientations, a control device, said housing and control device being mounted to provide relative motion between them when said elevator car moves relative to said structure, said control device including a surface effective to reflect electromagnetic radiation from said transmitter means to said receiver means when said elevator car is in a predetermined position relative to a selected landing, translating means operable from a first to a second condition when energized, said receiver means including a photoresponsive device and biasing means, said biasing means biasing said photoresponsive device to provide an output current regardless of the level of electromagnetic radiation the photoresponsive device is subjected to, said photoresponsive device changing the magnitude of its output current when subjected to electromagnetic radiation, and means responsive to the changes in the output current of said photoresponsive device, said means energizing said translating means when such changes occur at a rate within a predetermined range which includes the rate at which the electromagnetic radiation provided by said transmitter means is pulsed.

2. The elevator system of claim 1 wherein the biasing means includes means permitting the biasing level to change at a predetermined rate when the photoresponsive means is subjected to electromagnetic radiation, with the predetermined rate being selected such that the biasing level remains substantially constant during a pulse of electromagnetic radiation from the transmitter means.

3. The elevator system of claim 1 wherein the housing includes an opening, and cover means covering said opening formed of a material which transmits electromagnetic radiation of the wavelength provided by the transmitter means, and wherein the housing is configured such that the outer surface of said cover means is within imaginary vertical planes disposed about the housing, preventing foreign material from settling on said cover means.

4. An elevator system, comprising:

a structure having a plurality of landings and a hoistway, an elevator car mounted for movement in said hoistway to serve at least certain of the landings, a transmitter including an infrared light emitting diode and a pulse generator operative to pulse said light emitting diode at a frequency in the kilohertz range, a receiver including a phototransistor responsive to infrared light, a beam splitter constructed to reflect about one-half of an infrared light beam incident thereto, and to transmmit the remainder, a housing, said light emitting diode, said phototransistor and said beam splitter being mounted within said housing with predetermined orientations, a target mounted in said hoistway having a retrodirective surface which has the characteristic of returning a beam of infrared light to its source, said housing being mounted on said elevator car such that the retrodirective surface of said target reflects the pulses of infrared light from the light-emitting diode to the phototransistor via said beam splitter when the elevator car is in a predetermined position relative to said target, translating means operable from a first to a second condition when energized, biasing means electrically biasing said phototransistor to cause said phototransistor to continuously provide an output current, and coupling means responsive to a change in the output current of said phototransistor, said coupling means energizing said translating means when said changes occur at the frequency at which the light-emitting diode is pulsed.

5. The elevator system of claim 4 including threshold means providing a threshold voltage, and comparator means operable between first and second conditions, said threshold means and said comparator means being connected between the coupling means and the translating means, with the coupling means energizing the translating means only when its output exceeds said threshold voltage, which operates said comparator means from its first to its second condition.

6. An elevator system, comprising:

a structure having a plurality of landings and a hoistway, an elevator car mounted for movement in said hoistway to serve at least certain of the landings, a transmitter including an infrared light emitting diode and a pulse generator operative to pulse said light emitting diode at a frequency in the kilohertiz range, a receiver including a phototransistor responsive to infrared light, a beam splitter constructed to reflect about one-half of an infrared light beam incident thereto, and to transmit the remainder, a housing, said light emitting diode, said phototransistor and said beam splitter being mounted within said housing with predetermined orientations, a target mounted in said hoistway having a retrodirective surface which has the characteristic of returning a beam of infrared light to its source, said housing being mounted, on said elevator car such that the retrodirective surface of said target reflects the pulses of infrared light from the light-emitting diode to the phototransistor via said beam splitter when the elevator car is in a predetermined position relative to said target, translating means operable from a first to a second condition when energized, biasing means electrically biasing said phototransistor to cause said phototransistor to continuously provide an output current, said biasing means including means holding the electrical bias of the phototransistor substantially constant during each pulse of infrared light generated by the light-emitting diode while allowing the bias to change due to changes in ambient illumination of the phototransistor, and coupling means responsive to a change in the output current of said phototransistor, said coupling means energizing said translating means when said changes occur at the frequency at which the light-emitting diode is pulsed.

7. The elevator system of claim 6 wherein the means holding the bias of the phototransistor substantially constant during a pulse of infrared light from the light-emitting diode includes a circuit having a first capacitor, and wherein the coupling means includes a circuit having a second capacitor, with the time constant of the circuit which includes the first capacitor being substantially longer than the time constant of the circuit which includes the second capacitor.

* * * * *